United States Patent [19]

Keeton

[11] 4,419,950

[45] Dec. 13, 1983

[54] HOT WIRE CUTTER FOR AUTOMATIC SLEEVE MAKING MACHINE

[76] Inventor: John H. Keeton, P.O. Box 296, Campbellsville, Ky. 42718

[21] Appl. No.: 354,797

[22] Filed: Mar. 4, 1982

Related U.S. Application Data

[62] Division of Ser. No. 319,671, Nov. 9, 1981, Pat. No. 4,404,946.

[51] Int. Cl.[3] ..... D05B 65/00

[52] U.S. Cl. ..... 112/290

[58] Field of Search ..... 112/290, 130, 285, 291, 112/292, 129

[56] References Cited

U.S. PATENT DOCUMENTS 3,008,437 11/1961 Herr ..... 112/290
3,044,424 7/1962 Kehrer ..... 112/192 X
3,304,897 2/1967 Rubin ..... 112/290 X
3,413,944 12/1968 Spinrad et al. ..... 112/290
3,934,526 1/1976 Damast et al. ..... 112/290

*Primary Examiner*—H. Hampton Hunter
*Attorney, Agent, or Firm*—Cushman, Darby & Cushman

[57] ABSTRACT

A hot wire cutter assembly is associated with an automatic sewing machine and includes a guide block with a ramp mounted at the rear of the sewing machine. An electric resistance wire is mounted in a cut out formed in the guide block, in operative association with the ramp. The guide block and wire are positioned with respect to each other and the sewing machine so that a piece of fabric being stitched passes over the ramp, and the synthetic thread providing the stitching is automatically cut and a nub thereof is fused so that the ultimately remaining nub is of small size.

1 Claim, 20 Drawing Figures

Fig. 1
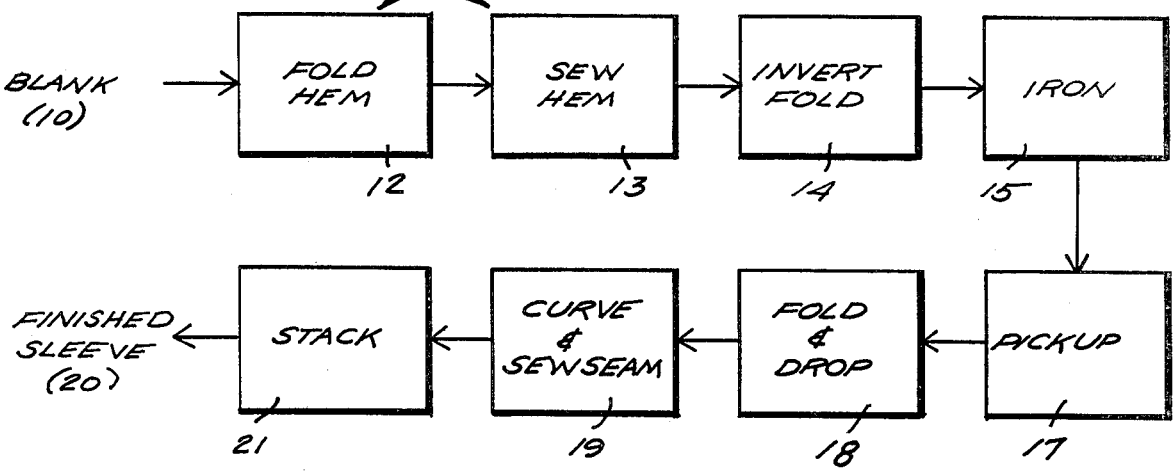
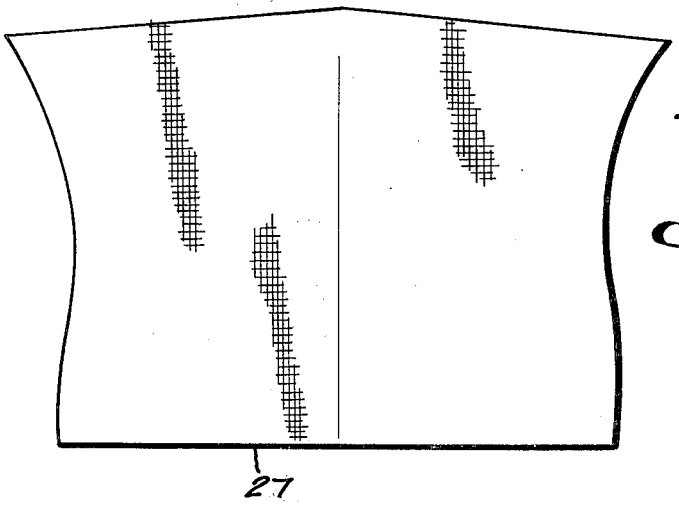
Fig. 2a
Fig. 2b
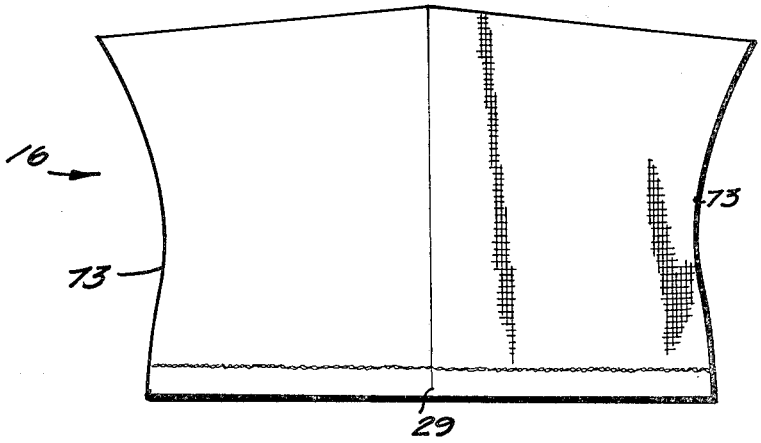
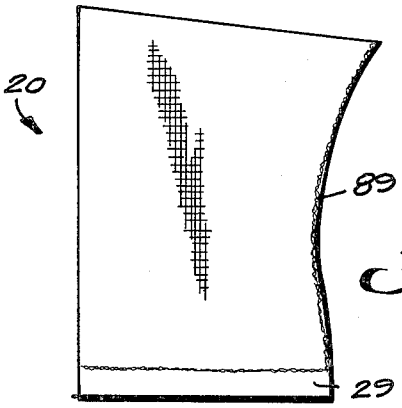
Fig. 2c

Fig. 11
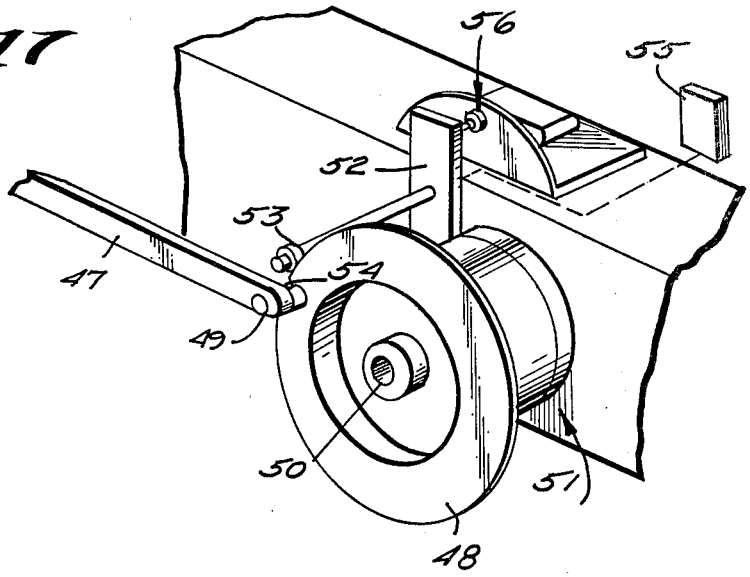
Fig. 8
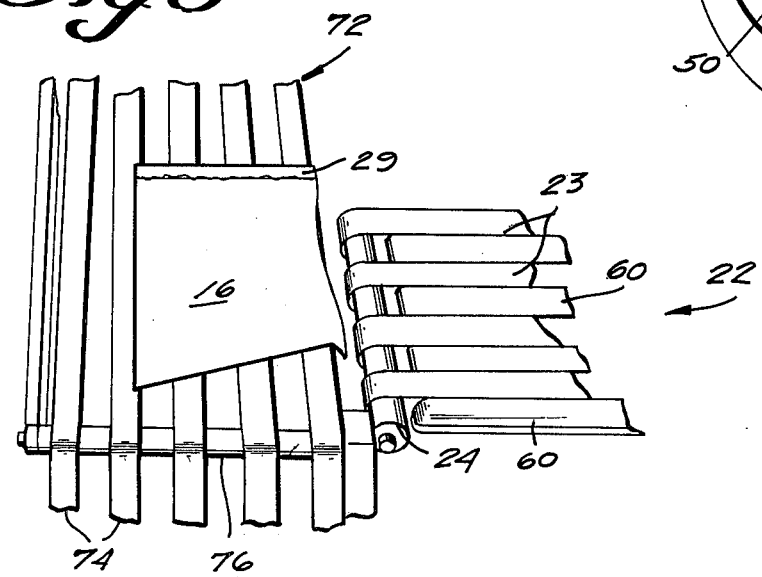
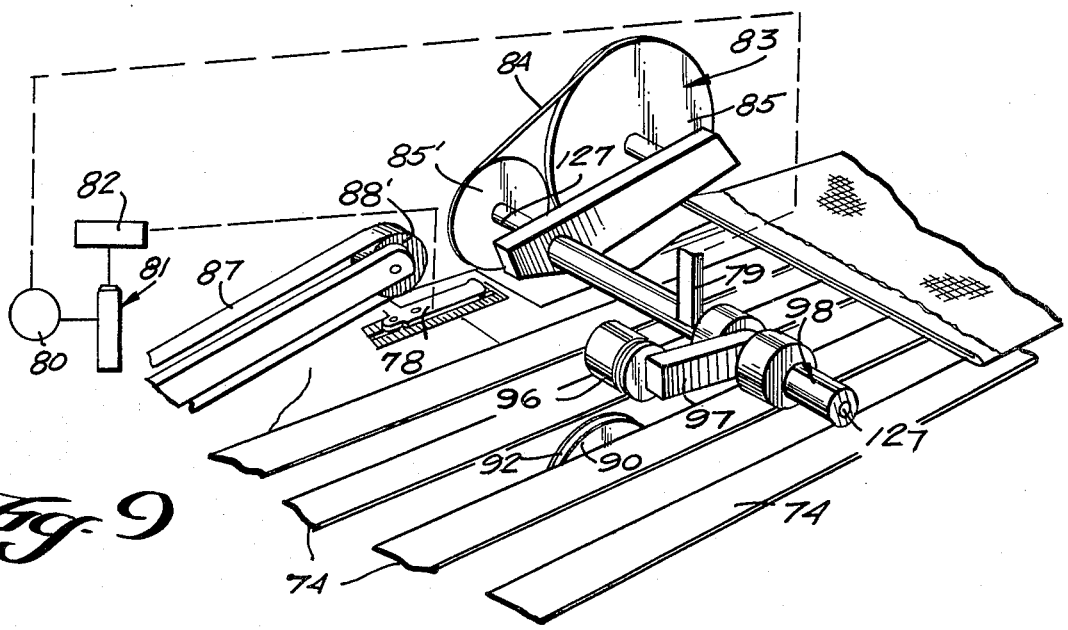
Fig. 9

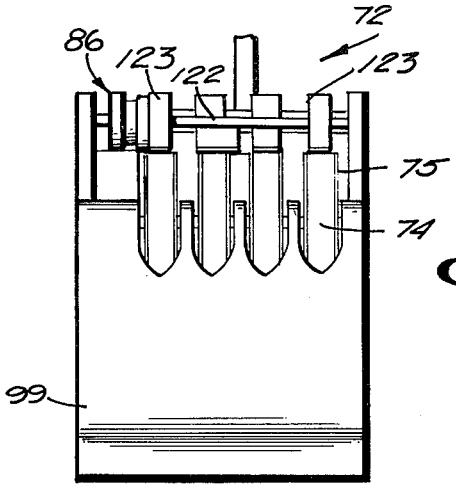
Fig. 10
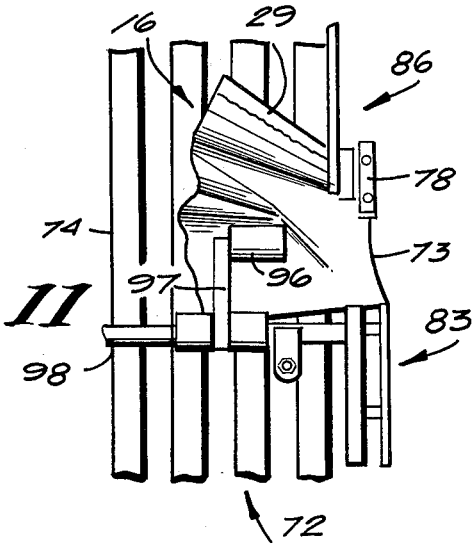
Fig. 11
Fig. 12
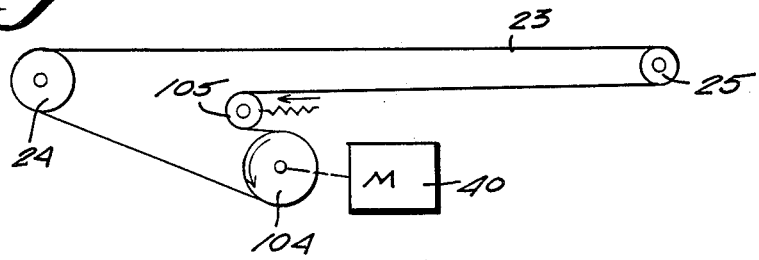
Fig. 13
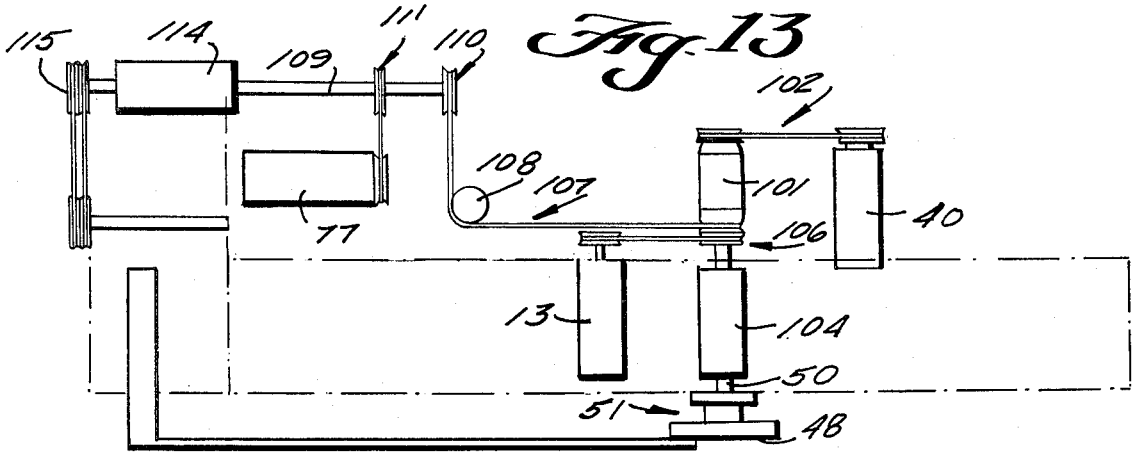

HOT WIRE CUTTER FOR AUTOMATIC SLEEVE MAKING MACHINE

CROSS-REFERENCE TO RELATED APPLICATION

This application is a divisional of U.S. Application Ser. No. 319,671 filed Nov. 9, 1981, now U.S. Pat. No. 4,404,946.

BACKGROUND AND SUMMARY OF THE INVENTION

The invention relates to a method in apparatus for acting upon cloth. While the invention is applicable to a wide variety of different procedures in operation, the primary focus of the invention is on the completely automatic production of shirt sleeves from a sleeve blank, particularly the formation of sleeves for T-shirt.

In the past, the commercial production of shirt sleeves, particularly T-shirt sleeves has been quite labor-intensive and expensive. A sleeve blank is cut from a larger piece of cloth, and then is fed by hand to a forming station whereat a hem is formed along one edge of the blank. The hem blank is then commonly manually removed from the forming station, folded over by hand, and passed by hand under an automatic sewing machine to form an arcuate seam along an edge of the blank generally transverse to the hem. Since many more sleeve blanks can be hemmed per unit time by the formation station than can be seamed, usually two or three workers are necessary to effect seaming for each forming stations. This results in the sleeve formation operation being very labor-intensive and relatively expensive, and a substantial floor area is required to accommodate the necessary workers and machinery.

According to the present invention, a method and appartus are provided that eliminate the drawbacks inherent in conventional commercial T-shirt sleeve production. According to the present invention, a single apparatus which takes up very little more floor space than a conventional forming station-automaically hems and seams a T-shirt sleeve blank to produce a complete T-shirt sleeve. Only a single operator is necessary, and production is as good, or perhaps even better, than is achieved at conventional forming stations also with a single operator.

According to one aspect of the present invention, a method of automatically forming a shirt sleeve from a sleeve blank is provided. The method comprises the steps of sequentially: (a) Conveying the blank in a first direction so that a first edge thereof moves substantially parallel to the first direction. (b) Automatically forming a hem along the first edge. (c) Automatically picking up the hemmed sleeve blank and folding it about an axis substantially transverse to the first edge. (d) Conveying the folded, hemmed blank in a second direction substantially transverse to the first direction, so that a second edge thereof is generally parallel to the second direction. And, (e) automatically stitching along the second edge to stitch overlapped portions of the folded blank together to form a shirt sleeve.

Between steps (b) and (e) the hem is automatically ironed so that it lays substantially flat. The second edge of the double-over hemmed blank conventionally has an arcuate portion, and according to the invention the blank is acted upon to move the second edge thereof in an arcuate manner, generally coincident with the arcuate portion of the second edge, as it is being acted upon by an automatic sewing machine, the stitching being practiced by forming a trimmed seam along the second edge.

The invention also comprises apparatus for practicing the method heretofore described. In fact that invention contemplates an assembly for acting upon cloth in general. The assembly includes a first conveyor disposed for conveying cloth generally horizontally in a first direction, and a first automatic sewing machine operably disposed alongside of the first conveyor for acting upon cloth being transported by the first conveyor. A second conveyor disposed generally at the end of the first conveyor, in the first direction, and disposed for conveying cloth generally horizontally in a second direction substantially transverse to the first direction. Means are operably mounted at an interface between the first and second conveyors for automatically transferring cloth from the first to the second conveyor; and a second automatic sewing machine is operably disposed alongside of the second conveyor for acting upon cloth being transported by the second conveyor.

A component part of the apparatus heretofore describe which is applicable to many procedures for acting upon cloth, or other objects, includes an assembly for picking up the objects off of an operating conveyor. The assembly includes a conveyor including a plurality of distinct, substantially parallel conveying portions, and a plurality of stationary surfaces interleaved with, and substantially parallel to, the conveying portions. Means are provided for mounting the conveying portions for movement from a first position to a second position. In the first position, the conveying portions are raised with respect to the stationary surfaces so that objects being transported by the conveying portions are transported over the stationary surfaces without touching them. In the second position, the conveying portions are depressed with respect to the stationary surfaces so that objects being transported by the conveying portions come in contact with the stationary surfaces and are no longer transported by them. Pickup means are provided for picking objects off of the stationary surfaces when objects are supported thereby, and means are provided for automatically moving the conveying portions from the first to the second positions thereof in response to the pickup means moving into operable association with objects being conveyed by the conveyor.

Another subassembly according to the present invention which has wide applicability for automatically effecting non-linear stitch formation in cloth comprises the following components:

A. conveyor for conveying the cloth in a predetermined linear direction. A stitching mechanism mounted in operable association with the conveyor for effecting stitch formation in cloth as it is being transported by the conveyor in the predetermined linear direction. And a differential-speed-cloth-engaging means for automatically engaging a portion of the cloth remote from the stitching mechanism, while the cloth is still being conveyed in the predetermined linear direction, an effecting movement of the cloth so that a portion of the cloth adjacent the stitching mechanism moves in a non-linear path as the cloth is being transported by the conveyor past the stitching mechanism. The conveyor preferably comprises a plurality of space conveyor belt portions, while the differential-speed-cloth-engaging means comprises a speed roller spaced from the stitching mechanism and rotatable about a horizontal axis perpendicular to the predetermined linear direction. The roller is rotated so that the cloth-engaging periphery thereof has an effective speed greater than the conveyor speed, which causes the arcuate movement of the cloth.

The invention also contemplates a hot wire cutter that is capable of simultaneously cutting the stitching formed by an automatic sewing machine after a cloth article is stitched, and fusing synthetic thread used during stitching so that no perceptible nub extends from the article.

It is primary object of the present invention to provide a method and apparatus for automatically acting upon cloth, and particularly for automatically forming T-shirt sleeves from sleeve blanks. This and other objects of the invention will become clear from the inspection of the detailed description of the invention, and from the appended claims.

Figure 3:
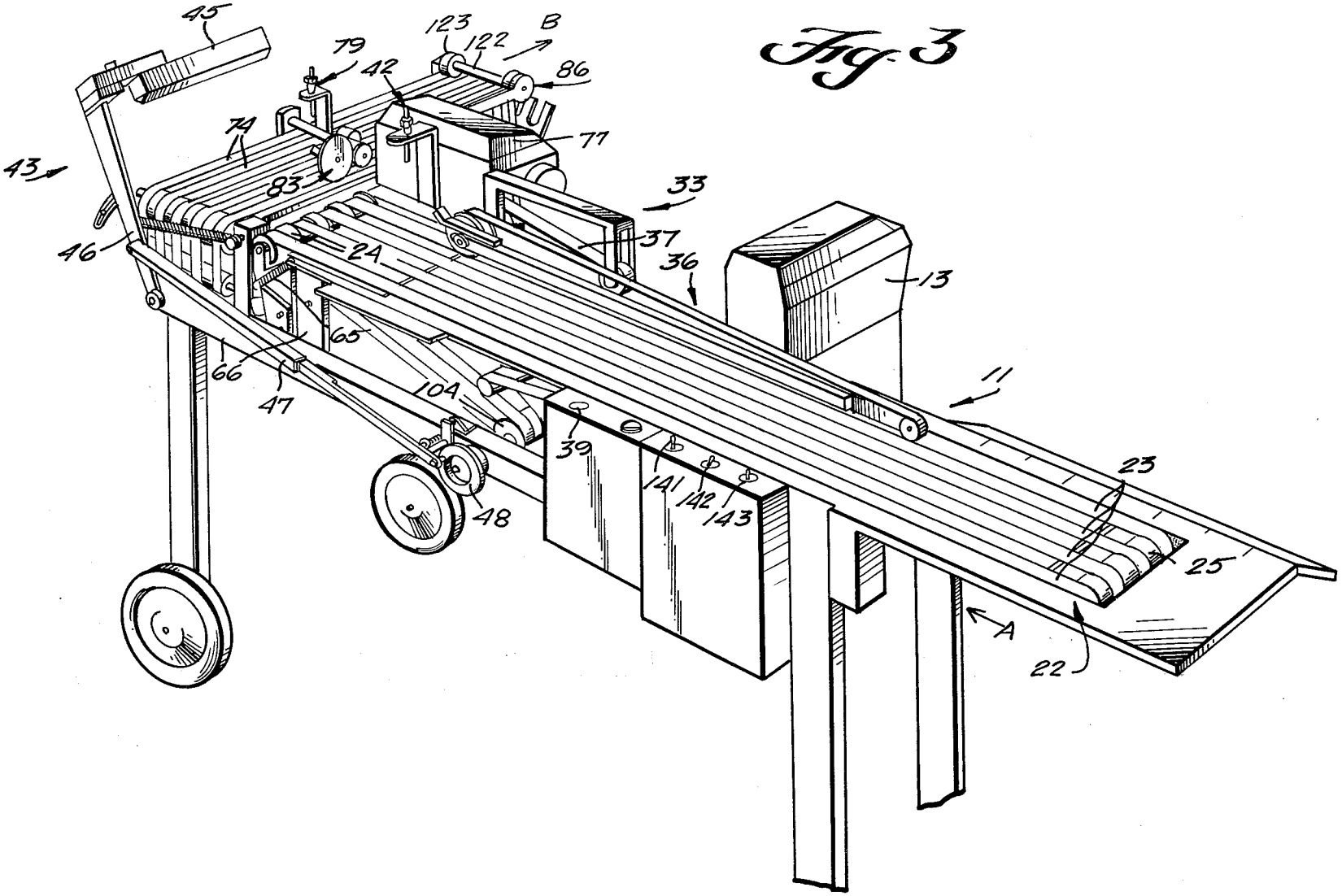
Figure 1:
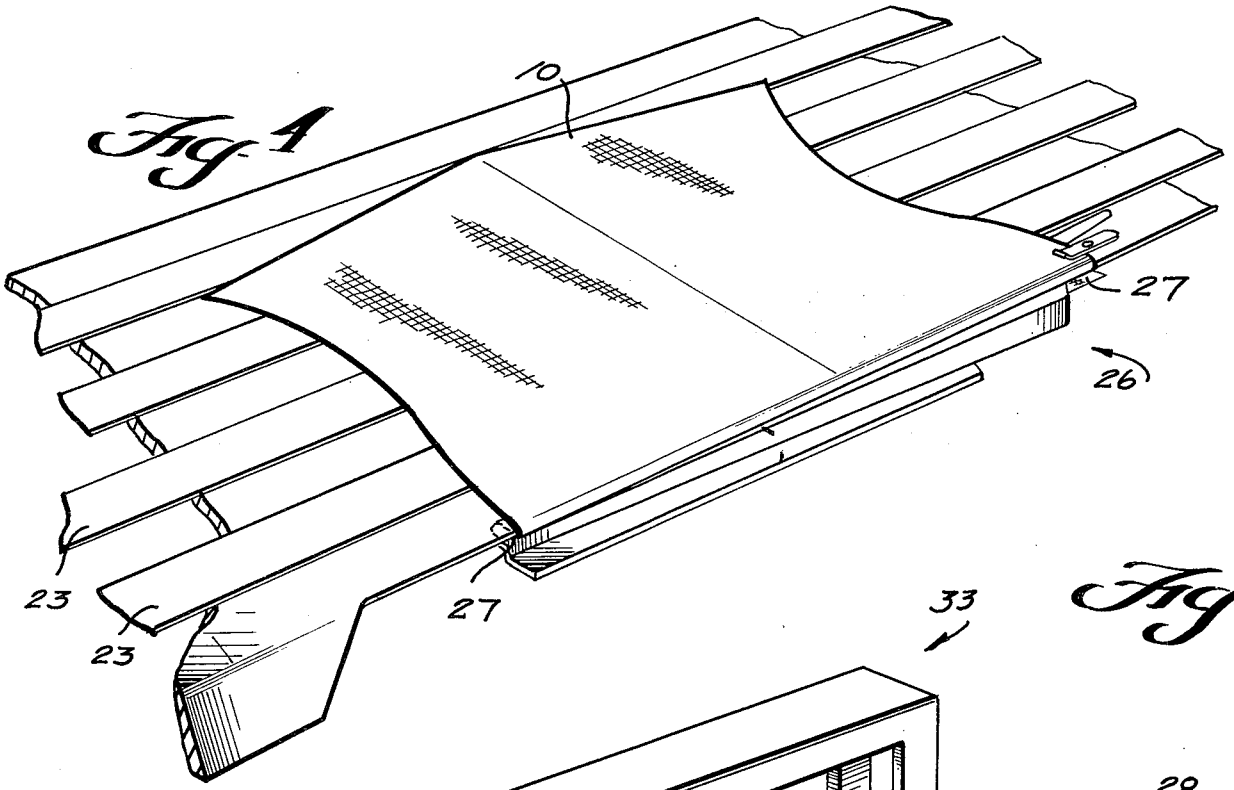
FIG. 1 is a schematic illustrating various stages in the production of shirt sleeves according to the present invention.
Figure 5:
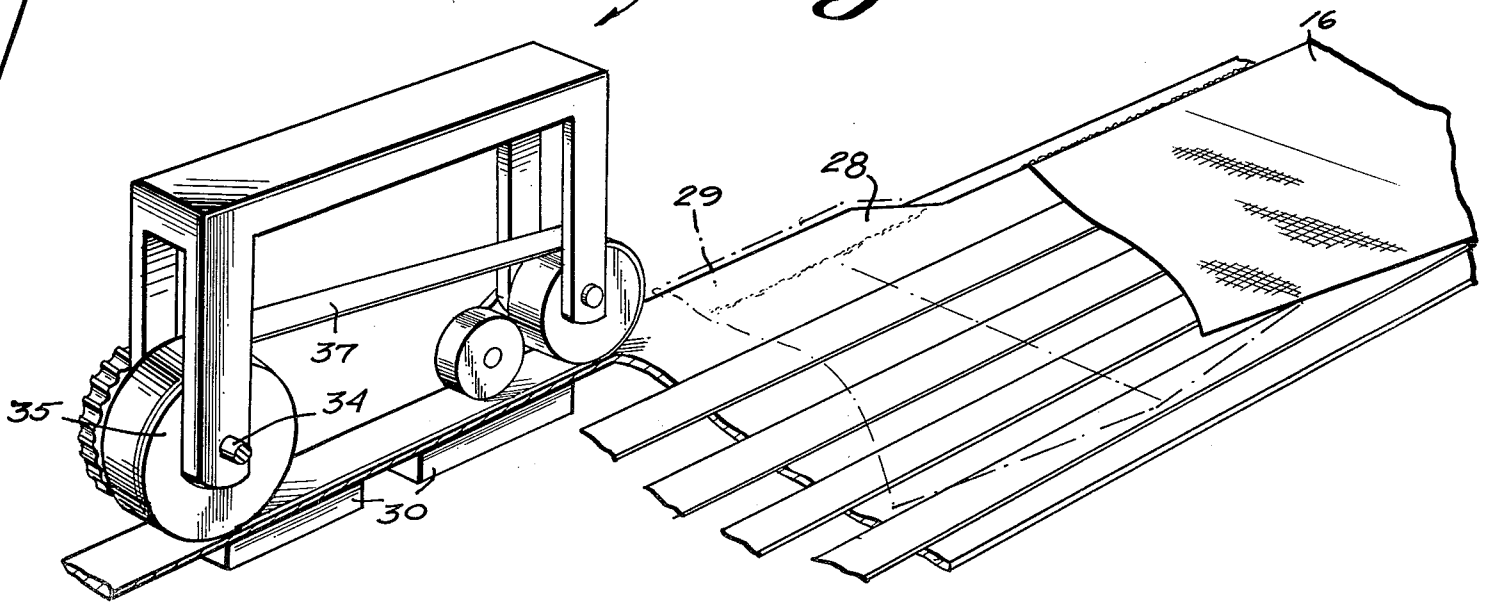
Figure 7:
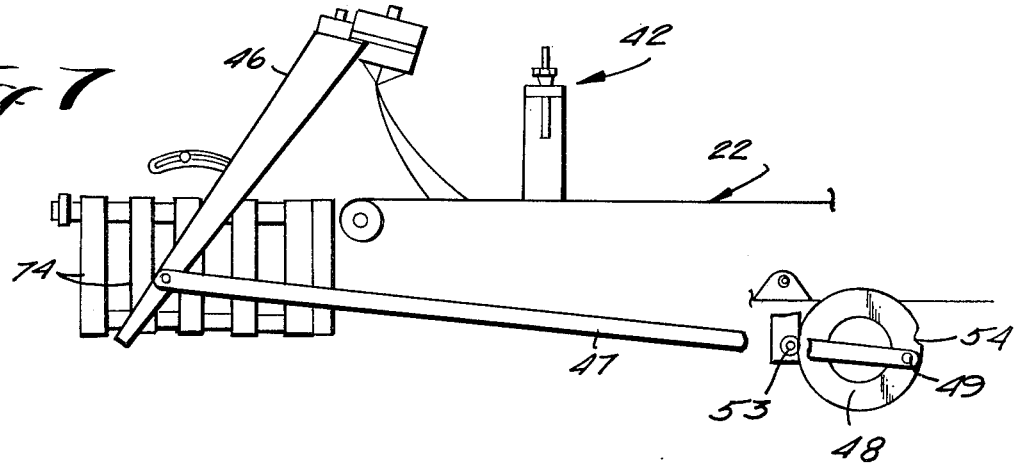
Figure 14:
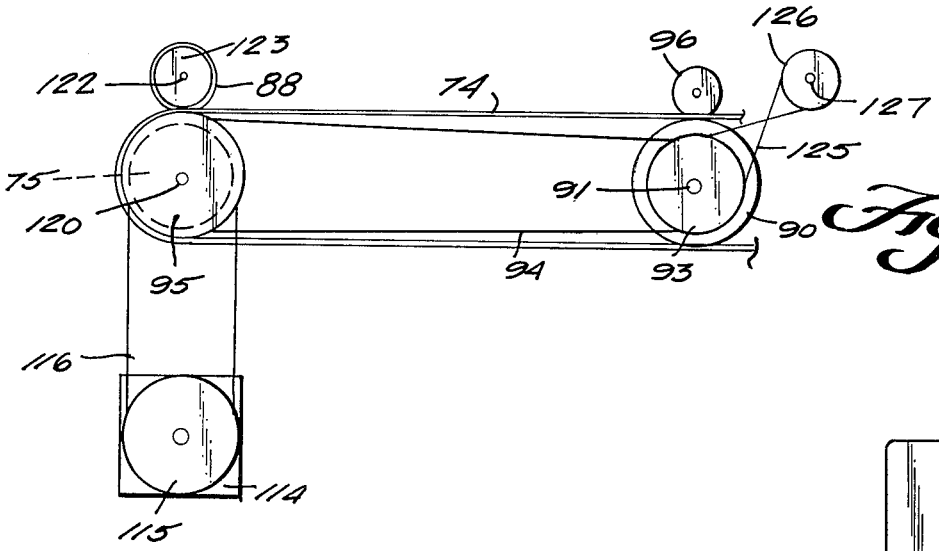
Figure 15:
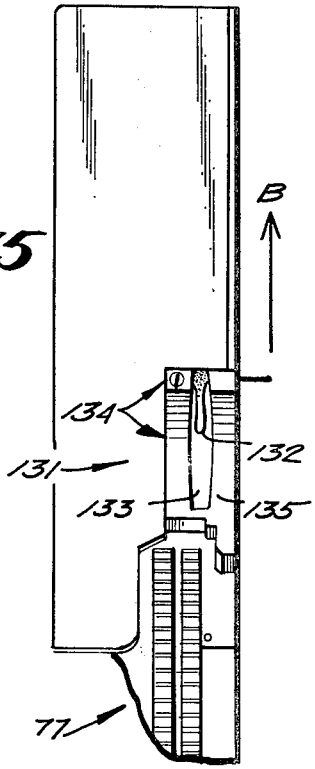
Figure 16:
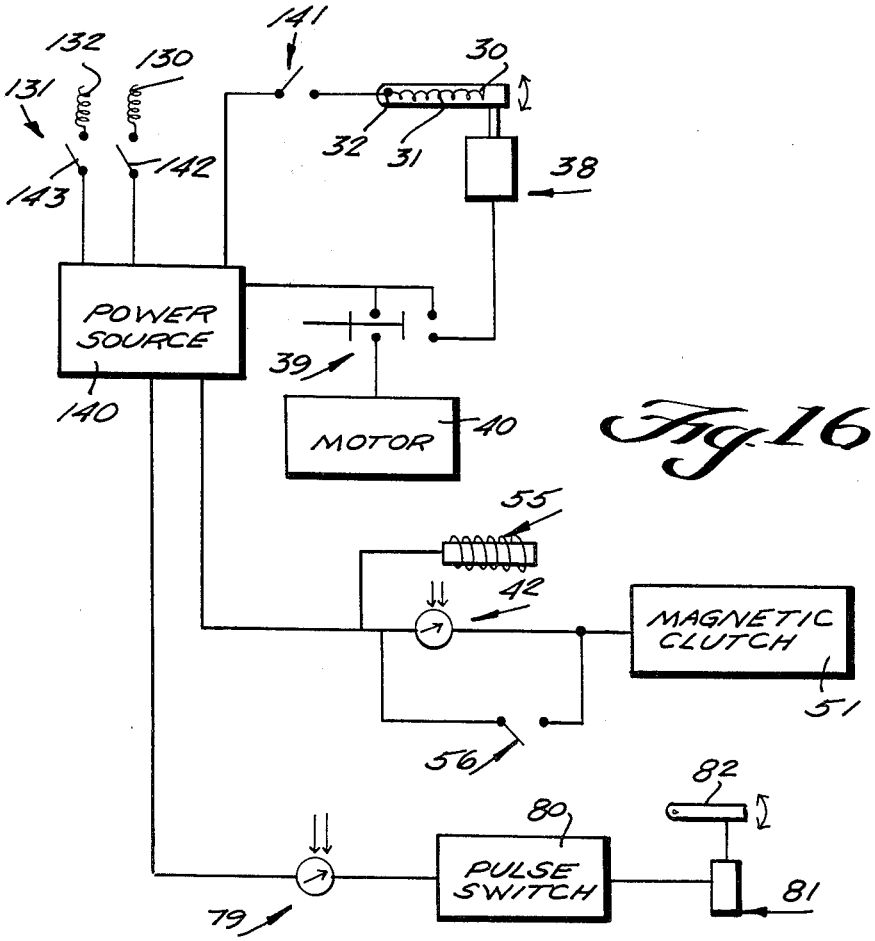

FIGS. *2a, 2b* and *2c* are, respectively, top views of a sleeve blank, hemmed blank, and finished sleeve;

FIG. 3 is a prespective view of exemplary apparatus for automatically forming shirt sleeves according to the present invention;

FIG. 4 is a detailed prespective view of a forming station of the apparatus of FIG. 3;

FIG. 5 is a detailed prespective view of an ironing and seam-inverting station of the apparatus of FIG. 1, with upper conveying belt removed for clarity of illustration;

FIGS. *6a* and *6b* are top and side views, respectively, showing the first conveyor of the apparatus of FIG. 1 at a cloth pickup point, the conveyor being illustrated in the "up" and "down" positions, respectively;

FIG. 7 is a side schematic view, with portions removed for clarity of illustration, showing the pickup head assembly of apparatus of FIG. 3 as it picks up a hemmed blank from the forming station conveyor;

FIG. 8 is a top prespective view illustrating the transportation of a hemmed sleeve blank from the pickup head by a second conveyor;

FIG. 9 is a top prespective view showing various structures for engaging the hemmed sleeve blank adjacent the area it is acted upon by an automatic sewing machine, with portions cut away for clarity;

FIG. 10 is an end view of the second conveyor of the apparatus of FIG. 3;

FIG. 11 is a top plan view of the second conveyor illustrating the positioning of the sleeve just prior to completion of seaming;

FIG. 12 is a side schematic view illustrating various drive components of the apparatus, particularly for the first conveyor;

FIG. 13 is a top plan schematic of the drive means of FIG. 12, and also illustrating the drives for the second conveyor and related components;

FIG. 14 is a side schematic view of drive components associated with the second conveyor;

FIG. 15 is a top view of the hot wire cutter assembly associated with the second automatic sewing machine;

FIG. 16 is an electrical schematic illustrating the interrelationship between various electrically powered components of the apparatus; and FIG. 17 is a detail perspective view of the pickup head drive components when in the atrest position.

DETAILED DESCRIPTION OF THE DRAWINGS

FIGS. 1 and 2 schematically illustrate the practice of the present invention to form shirt sleeves from sleeve blanks, particularly T-shirt sleeves. The sleeve blank 10 is fed to a forming station 11, where the hem is folded by a folding apparatus 12, and sewn by an automatic sewing machine 13. The hem is upside down at this point, and it is inverted at the station 14 and ironed at station 15 so that it assumes the configuration of the hemmed blank illustrated at 16 in FIG. *2b*. The hemmed blank 16 is then transported by a conveyor to a pickup station 17, whereat it is picked up and folded by a pickup head and subsequently dropped at station 18, on a second conveyor. It is moved on the second conveyor, so that a second edge thereof is generally parallel to the direction of conveyance by the second conveyor, toward a second automatic sewing machine. At station 19, it is moved into operative association with the automatic sewing machine, and a part of the sleeve blank is engaged by a roller or wheel travelling with a higher peripheral velocity than the velocity of the conveyor, which curves the portion of the blank 16 being fed to the second sewing machine so that an arcuate seam is formed. The finished sleeve, illustrated by reference 20 in FIG. *2c*, is then moved off the end of the second conveyor and stacked at a stacking station 21.

The details of exemplary apparatus for practicing the method described above—which apparatus (and components thereof) is useful for other operations also—is illustrated in FIGS. 3–17.

The first portion of the apparatus comprises the forming station 11. A first conveyor 22, which preferably comprises a plurality of spaced conveying portions (belts) 23 which move around front and rear rollers 24, 25, respectively, operates to convey cloth disposed thereon in the first direction A. A particularly bent piece of metal 26, as illustrated most clearly in FIG. 4, provides for folding the first edge 27 of the sleeve blank 10 to form a hem. The sleeve blank 10 is placed on the conveyor 22 by the operator, and then is automatically, moved so that the edge 27 contacts the guide 26 at station 12. After the hem fold is formed, the blank 10 passes on to the first automatic sewing machine 13, wherein it is stitched and trimmed. The machine 13 may comprise any conventional type, such as a Union Special Mark IV. The formation station 11 is basically conventional, except that usually the hem has a slightly different orientation when exiting the forming station.

When the hemmed blank 16 exits the forming station 11, the hem is folded under the rest of the cloth. For subsequent operations it is desirable to move the hem back into the position wherein it is substantially planar with the rest of the cloth, and this is accomplished at the invert station 14. A metal guide 28, which is shown mostly clearly in FIG. 5, effects the inversion of the hem 29 (see FIG. *2b*) as it is conveyed by conveyor 22 into contact therewith.

Immediately after the invert guide 28 is the ironing station 15. The ironing station 15 includes a flat piece of metal 30 which is wider than the hem 29, and acts as an iron. An electric resistance wire 31 (see FIG. 16) is disposed interiorly of the metal plate 30, and preferably the plate 30 is pivotal about a horizontal pivot pin 32. In order to hold the hem and adjacent portions of the blank 10 in contact with the iron plate 30 to get effective ironing action, a pressing belt assembly 33 is provided. The pressing belt assembly is mounted just above the iron 30, and is powered. Preferably the pressing belt assembly is mounted for rotation about a shaft 34 (which also drives the roller 35 of the pressing belt assembly 33) so that it can be moved out of the way to allow access to the iron or the like to effect repairs, etc. The top guide belt assembly 36, which runs along the forming station 11 to properly position the blank 10 during hemming, also is preferably pivoted about the shaft 34 and movable out of the way.

Since the belt 37 of the pressing belt assembly 33 would be destroyed if it were left in contact with the iron 30 while stationary with the iron on, a mechanism is preferably utilized to move the iron 30 downwardly out of contact with the belt 37 when the conveyor 22 and pressing belt assembly 33 are not operating. This preferably comprises a piston cylinder assembly 38 (see FIG. 16) which is actuated by switch 39 and is automatically cut out whenever the motor 40 which drives the conveyor 22 is not operating.

After the ironing station 15, the hemmed blank 16 moves toward the end (in the first direction A) of the conveyor 22 to what is a pickup station 17. The movement of the blank 16 is sensed by the electric eye 42, or other automatic sensing means, which automatically actuates a pickup head assembly 43. The pickup head assembly 43 preferably is of the type disclosed in copending application Ser. No. 283,977 filed July 16, 1981 (the disclosure of which is hereby incorporated by reference herein), and includes a cloth engaging head portion 45 which actually clamps onto the blank 16, a lever 46 mounting the head 45 for pivotal movement about a horizontal axis perpendicular to the direction A, a link 47 for effecting movement of the level 46, and a rotating disc 48 to which the link 47 is mounted by a pivotal connection 49 (see FIGS. 7 and 17 in particular). The pivotal connection 49 is offcenter with respect to the disc 48, and the disc 48 is connected by a magnetic clutch to a drive shaft 50 (see FIGS. 12 and 13). The magnetic clutch 51, which is conventional, is activated by the electric eye 42. A pivoted latch lever 52 has a roller 53 at the end thereof which engages a detent 54 in the circumferential periphery of the disc 48 to hold the disc in place in its inoperative position. A solenoid 55 (see FIGS. 16 and 17) is operatively associated with the latch lever 52 to move the roller 53 thereof out of engagement with the detent 54 when the magnetic clutch 51 is activated. After the disc makes one complete revolution (one complete operation of the pickup head assembly 43), a switch 56—which is in operative engagement with the latch lever 52—is opened to prevent further passage of current to the magnetic clutch 51 (until a subsequent sensing by the electric eye 42) so that only a single operation of the pickup head assembly 43 is practiced each time a blank 16 is sensed by mechanism 42.

The end of the conveyor 22 cooperates with the pickup head assembly 43 to allow pick up of the hemmed blank 16. The conveyor end construction to be hereinafter described is useful with other objects and pickup assembly besides those illustrated, and utilizing such an arrangement it is possible to arrest the movement of the object to be picked up at the point of pickup, while not stoping the conveyor.

The end of the conveyor 22 adjacent the pick up head assembly 43 comprises a plurality of stationary surfaces 60 (see FIGS. 6*a* and 6*b*) interleaved with, and substantially parallel to, the conveying portions 23 of the conveyor 22. Means are provided for mounting the conveying portions 23 for movement from a first position—illustrated in FIGS. 3 and 6*a*—wherein the conveying portions 23 are raised with respect to the stationary surfaces 60 so that the hemmed blank 16 being transported by the conveying portions 23 is transported over the stationary surfaces 60 without substantially touching them; to a second position—illustrated in FIG. 6*b*—wherein the conveying portions 23 are depressed with respect to the stationary surface 60 so that the hemmed blank being transported by the conveying portions 23 come in contact with the stationary surfaces 60, and are no longer transported by belts 23.

Figure 6A:
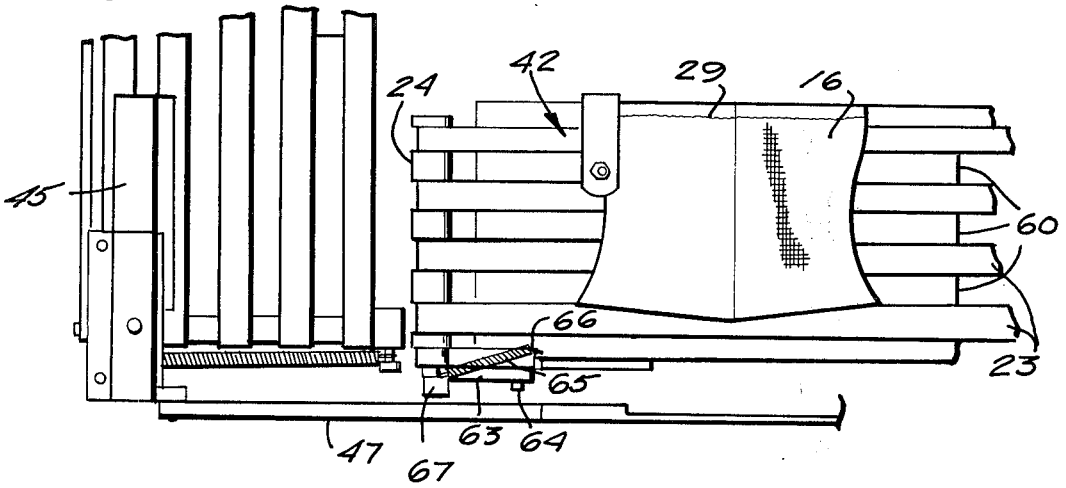
Figure 6B:
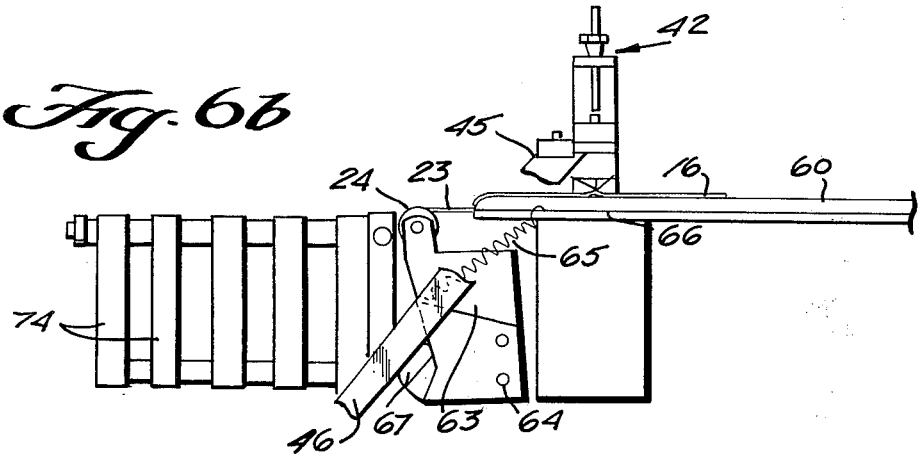

The mounting means for the conveying portions 23 that allows this movement preferably includes the following components: A forward idler roller 24, having grooves formed therein for receipt of the belts 23, and rotatably about a shaft 62. A pair of plates (only one of which is shown in FIGS. 6*a* and 6*b*) 63 mounting the shaft 62 at either end thereof, the plates 63 themselves pivotal about a horizontal axis defined by pivot pins 64 which are parallel to shaft 62 and located vertically below and in back of it. A coil spring 65 engaging the plate 63 and a stationary frame portion 66 for biasing the plate 63 (and belts 23) to the position illustrate in FIG. 6*a*. And an operating lever 67 mounted to plate 63 spaced from the pivot pin 64 and engageable by the lever 46 of the pickup head assembly 43. When the head portion 45 of the pickup head assembly 43 moves right over the conveyor 22, the lever 46 engages the operating lever 67 to effect pivotal movement of the plate 63 about pivot pin 64, and movement of the conveyor belts 23 from the raised position illustrated in FIG. 6*a* to the depressed position illustrated in FIG. 6*b*. Thus, the movement of the hemmed blank 16 is temporarily arrested so that the head portion 45 can engage it, and pick it up as it is moved by lever 46 back toward its rest position.

The head portion 45 of the pickup head assembly 43 engages the hemmed blank 16 essentially at a centerline thereof (perpendicular to the direction A), and thus as the head 45 returns to its rest position and lifts up the hemmed blank 16 it folds the blank 16 in half. When the plunger operating lever 69 of the head 45 engages the stationary stop 70 to release the clamping jaws of the head 45, the hemmed blank 16 is above a second conveyor 72, with only a small part of a second edge 73 (see FIG. 2*b*) of the hemmed blank 16 laying over the edge of the second conveyor 72. The second conveyor 72 conveys the blank 16 in a second direction B, the second edge 73 being generally parallel to the direction B (although preferably—as illustrated in FIG. 2*b*—the second edge 73 includes at least a portion thereof that is arcuate). The second conveyor 72 is much like the first conveyor in that a plurality of spaced conveyor belts 74 are provided with idler rollers 75, 76 at the "front" and "rear" edges thereof. The direction B is substantially transverse to the direction A.

Mounted in operative association with the second conveyor 72 is a second automatic sewing machine 77, which also is of conventional type such as a Union Special Mark IV. It includes a front foot 78 beneath which the second edge 73 of the folded blank 16 (and surrounding material) passes, the second sewing machine 77 ultimately seaming the blank 16 along or adjacent to the edge 73, and effecting trimming thereof.

Since a portion of the hem 29 will, of course, also need to pass under the foot 78, and since there are four thicknesses of cloth at that point, preferably a mechanism is provided for lifting the foot 78 automatically in response to the approach of the hem 29, and then moving the foot 78 back down once the hem 29 has pass beneath it. This is preferably accomplished by utilizing an automatic sensing means such as sensing electric eye 79 which actuates a pulse switch 80 (see FIGS. 9 and 16), which in turn activates a piston-cylinder arrangement 81 which operates a lever system 82 connected to foot 78 to effect momentary upward movement.

To assist feeding of the folded-over hemmed blank 16 to the second sewing machine 77, a small tuck roller system 83 is provided, including a thin belt 84 rotatable about wheels 85, 85' (see FIG. 9). To assist in conveying the seamed portions of the blank 16 away from the second sewing machine 77, a top feed conveying system 86 preferably is provided. This includes a thin belt 87 rotatable about rollers 88, 88'. Both the systems 83, 86 preferably are pivotal at one end thereof to allow movement thereof out of the way (as illustrated in FIG. 9) to allow access to underlying components for maintenance, repair, or the like.

In the formation of most shirt sleeves, and particularly T-shirt sleeves, it is necessary that the seam 89 (see FIG. 2*c* in particular) have at least a portion thereof that is arcuate. In order to provide automatic arcuate seam formation, a differential-speed-cloth-engaging means is provided for automatically engaging a portion of the sleeve blank 16 remote from the sewing machine 77, while the cloth is being conveyed in direction B, to effect movement of the blank 16 so that a portion thereof (second edge 73 and surrounding material) adjacent the sewing machine 77 moves in a non-linear path (preferably arcuate path) as the blank 16 is being transported by the conveyor 72 pass the sewing machine 77. Such a means is most clearly illustrated in FIGS. 9 and 14, and includes a thin speed roll 90 mounted for rotation about a horizontal shaft 91 perpendicular to the direction B, and positioned between a pair of belts 74 of the second conveyor 72' and remote the from the sewing machine 77, but in substantial horizontal alignment with the sewing machine 77.

A friction material, such as a strip of rubber 92, preferably is provided on the periphery of the roller 90 to positively engaged the bottom of the blank 16. The position of the shaft 91 may be adjusted in the direction B with respect to the sewing machine 77 depending upon the particular configuration of the seam to be formed (that is if it is to have a straight portion or the like), and the speed of the roller 90 is varied depending upon the exact nature of the arcuate seam to be formed. This is preferably accomplished by providing a variable speed pulley 93 (see FIG. 14) mounted at the end of shaft 91 for engagement by a drive belt 94. Because of its size relative to that of the drive pulley 95 (which also engages belt 94), the periphery of the roller 90 moves at a speed faster than the linear speed of the conveyor belt 74 in direction B.

An idler roller 96 (see FIGS. 9 and 11 in particular) of massive material (e.g., thick steel) is pivotally mounted to a level 97, which in turn is pivotally mounted at the other end thereof to a stationary tube 98. When the lever 97 is pivoted so that the idler 96 is in its down, operative, position, it provides a force on the top of the blank 16 which allows the periphery 92 of the speed roller 90 to grip the cloth. Since the periphery of the roller 90 is moving faster than the conveyor belt 74, and since the cloth basically has a pivot point where the automatic sewing machine 77 is effecting stitching thereof, the cloth is moved about the pivot point and the desired arcuate seam is automatically formed. FIG. 11 shows a typical T-shirt sleeve 20 just prior to completion thereof; note that when the roller 90 and idler 96 no longer engage the cloth, the folds F illustrated in FIG. 11 must smooth out, and the second edge along which seam 89 is formed is arcuate, as illustrated in FIG. 2*c*.

After completion of the finished sleeve 20, at the curve and sew station 19, the sleeve 20 approaches the end of the second conveyor 72, and pivoted plate 99 (see FIG. 10) at the end thereof is actuated, and the sleeve 20 is neatly moved off of the conveyor 72 and stacked at stack station 21 in a box, or the like. Thus, there is no human input from the time the original sleeve blank 10 is laid on the first conveyor 22 until the completed sleeve 20 is stacked.

Exemplary components for driving the various structures of the apparatus are illustrated most clearly in FIGS. 12 through 14. A single motor (such as a three quarter horse power AC motor) 40 powers all of the driven components, including the sewing machines 13, 77. A central gearbox 101 is connected to motor 40 by a belt and pulley assembly 102, and a central shaft 50 is connected directly to the output from the gearbox 101. On the end of the central shaft 50 is the magnetic clutch 51 (and disc 48), as well as power roller 104 for the first conveyor 22. A spring biased idler 105 cooperates with the power roller 104 to provide tension for all of the belts 23, to effect movement of the conveying surface of the belts 23 in the direction A (see FIG. 12).

Also connected to the output from the gearbox 101 is a belt and pulley system 106 for driving sewing machine 13. Further, the output from gearbox 101 includes a belt and pulley system 107, including a direction-changing idler roller 108, to effect powering of shaft 109. Drive pulley 110 at the end of shaft 109 effects rotation thereof, while pulley 111 on shaft 109 is operatively connected to power the second sewing machine 77.

The shaft 109 extends into a gearbox 114, and an output pulley 115 from the gearbox 114 drives all of the components associated with the second conveyor belt 72 (including drive roller 75) and related components. The pulley 115 is operatively connected by belt 116 to a drive pulley 95. This comprises a double pulley system, and includes belt 94 connected to the variable speed pulley 93 for the speed roller 90. The shaft 120 operatively connected to the drive pulley 95 is also connected to the lead roller 75 of second conveyor 72, to power the belt 74. The top feed belt assembly 86 is also powered by this since the drive roller 88 thereof is disposed on the same shaft 122 as the friction wheels 123. The friction wheels 123 are driven due to their engagement with the conveyor belts 74 (and the cloth when disposed therebetween).

The tuck roller system 83 is also powered by the same drive components. The shaft 91 contains a double pulley system, the conventional variable speed pulley 93, and another pulley (not shown). Since the drive for the tuck roller system is opposite that of the other components a twisted belt 125 extends between the pulley and shaft 91 and the drive pulley 126 for the tuck roller system 83. The pulley 126 and the drive roller 85' for the system 83 are mounted on the same shaft 127, shaft 127 passing through tube 98 (see FIG. 9).

Each of the sewing machines 13, 77, also includes a hot wire cutter associated therewith to cut off the stitching produced by the machine after the cloth moves therepast. The hot wire cutter associated with the first sewing machine 13 is conventional, and is illustrated schematically at 130 in FIG. 16, while the hot wire cutter associated with the sewing machine 77 is unusual, and is illustrated generally by reference numeral 131 in FIGS. 15 and 16. The cutter system 131 includes the actual electric resistance heating coil 132, which is relatively flat, and which is mounted centrally in cut-out 133 in a cloth guide structure 134, which includes a ramp 135. The coil 132 and the ramp 135 are so positioned and dimensioned that as the finished trailing edge of the finished sleeve 20 exits the sewing machine 77 and passes over the guide 134, it is moved up the ramp 135 so that the termination of the stitching therein passes in cut out 133 and in contact with coil 132. The coil 132 then effects cutting of the synthetic (e.g., polyester) stitching thread, while also effecting fusing of the nub at the end of the sleeve. This fusing action greatly reduces the size of the nub so that no further action on the stitching is necessary in order to provide the finished product.

FIG. 16 illustrates the control schematic for the automatic sleeve forming apparatus according to the invention. An AC power source 140 preferably powers all the components, including the electric resistance coils 31, 130, 132, the motor 40, the solenoid 55, the photoelectrical systems 42, 79, the magnetic clutch 51, and the pulse switch 80. The main switch 39 for the motor 40 includes two bridging contacts, and operates the piston-cylinder assembly 38 for the iron 30 at the same that it operates motor 40. Manually actuated control switches 141, 142, and 143 are provided for the supply of electricity to the coil 31, 130, 132 respectively. All of the control switches 39, 141, 141, and 143 preferably are mounted on the opposite side of the first conveyor 22 as the operator, but in position to be readily controlled by the operator.

Operation

An exemplary operative procedure according to the invention will now be described:

The blank sleeve 10 is placed on the conveyor 22 at the start of the formation station 11, with the first edge 27 substantially parallel to the first direction of conveyance A. The conveyor 22 transports the blank 10 so that the first edge 27 engages the metal hem guide 26, and a hem is formed and fed into first sewing machine 13 wherein the hem is stitched. As the blank 10 is continuously conveyed, the formed hem 29 engages the invert guide 28, causing the hem 29 to assume a substantially coplanar position with the rest of the blank 10, and then the hem 29 passes underneath pressing belt 37 and over iron 30. The iron 30 and pressing belt 37 smooth out the blank adjacent the hem, and iron down the hem 29 so that it has a relatively even configuration and relatively small size so that it will not interfer with the subsequent seaming of the blank. The complete hemmed blank 16 exits from the ironing station 15 and is continuously conveyed toward the pickup station 17.

As the hem blank 16 passes from the ironing station 15 toward the pickup assembly 17, the position thereof is sensed by the electric eye assembly 42. When the lead edge of the hem blank 16 is sensed, the solenoid 55 and magnetic clutch 51 are activated, the solenoid 55 moving the roller 53 of latch lever 52 out of the detent 54 in disc 48, in the movement of latch lever 52 closing the switch 56. The disc 48 is then connected to the power shaft 50 by the magnetic clutch 51, and the disc 48 is rotated in one revolution.

During the revolution of the disc 48, the link 47 is moved to pivot the lever 46 about its axis, and thereby move the pickup head portion 45 from its rest position to a position over the conveyor 22. As the head portion 45 moves toward the conveyor 22, and the hemmed blank 16 which is thereon is being continuously conveyed thereby, a portion of the lever 46 engages operating lever 67 connected to the plate 63, causing the conveyor belts 23 of first conveyor 22 to be moved below the level of the stationary surfaces 60 (from the position of FIG. 1 to that of FIG. 2). This effectively arrests movement of the hemmed blank 16 at the instant of pickup, while operation of the conveyor 22 is not affected, and the jaws of the pickup head 45 grasp the hemmed blank 16.

As the disc 48 continues in its rotation, the lever 46 is pivoted back towards its rest position, the head 45 having pickup the hemmed blank 16 adjacent the centerline thereof. As head 45 lifts the hemmed blank 16, it thus automatically folds it substantially in half, and once the plunger lever 69 engages the stationary stop 70 the hemmed blank 16 is over the second conveyor 72. The hemmed blank 16 is then dropped on second conveyor 72 with the second edge 73 of the blank 16 generally (although not completely since it includes an arcuate portion) parallel to the second direction B.

The continuously operating second conveyor 72 transports the hemmed blank from the fold- and-drop station 18 to the curve and seam station 19—that is toward second sewing machine 77. The leading edge of the hemmed blank 16 is sensed by the second electric eye system 79, which actuates pulse switch 80, which in turn ultimately causes the foot 78 of second sewing machine 77 to be lifted so that the hem 29 at the second edge 73 of the hemmed blank 16 can pass into operative association with the second sewing machine 77. The foot 78 is then automatically moved back downwardly, and the tuck roller system 83 assists the conveyor 72 in moving the hemmed blank 16 into engagement with the second sewing machine 77.

The speed wheel 90 engages a portion of the hemmed blank 16 remote from the sewing machine 77, and effects pivotal movement of the cloth with the operative components of the sewing machine 77 essentially providing the pivot point. This causes the second edge 73 to move in an arcuate path, so that an arcuate seam 89 is formed along the second edge 73.

The top feed system 86 and the conveyor 72 move the finished sleeve 20 away from the second sewing machine 77, and pivoted plate 99 is automatically actuated by any conventional means to move the finished sleeve 20 off of the second conveyor 72, and stack it at stacking station 21.

It will thus be seen that according to the present invention a method and apparatus are provided which effect the completely automatic formation of shirt sleeves and the like, as well as providing general operative acts upon cloth or other objects for accomplishing useful functions. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A hot wire cutter assembly associated with an automatic sewing machine stitching with synthetic thread, and comprising:

a guide block mounted at the rear of said automatic sewing machine, and having a ramp portion formed therewith;

an electric resistance heating coil mounted within a cut out formed in said guide block, and in operative association with said ramp; and said guide block and said coil positioned with respect to each other and said automatic sewing machine so that a piece of fabric being stitched by said automatic sewing machine after exiting said automatic sewing machine automatically passes over said ramp, and the synthetic thread providing said stitching is cut and a nub thereof is fused so that the ultimately remaining nub is of small size.

* * * * *